US011701908B2

(12) United States Patent
Khan et al.

(10) Patent No.: US 11,701,908 B2
(45) Date of Patent: Jul. 18, 2023

(54) MEDIA PROCESSING DEVICES FOR APPLYING PRINTABLE CONDUCTIVE ELEMENTS

(71) Applicant: ZEBRA TECHNOLOGIES CORPORATION, Lincolnshire, IL (US)

(72) Inventors: Nisa A. Khan, Buffalo Grove, IL (US); Gene A. Hofer, Lake Zurich, IL (US); Mohannad Abdo, Clifton, NJ (US); Frederick Robert Grabiner, Delray Beach, FL (US); John Olson, Dayton, NJ (US); Steven J. Vandercar, Rolling Meadows, IL (US)

(73) Assignee: Zebra Technologies Corporation, Lincolnshire, IL (US)

( * ) Notice: Subject to any disclaimer, the term of this patent is extended or adjusted under 35 U.S.C. 154(b) by 199 days.

(21) Appl. No.: 17/223,765

(22) Filed: Apr. 6, 2021

(65) Prior Publication Data

US 2022/0314672 A1 Oct. 6, 2022

(51) Int. Cl.

| | |
|---|---|
| ***B41J 2/325*** | (2006.01) |
| ***B41J 35/04*** | (2006.01) |
| ***B41J 33/14*** | (2006.01) |
| ***B41J 31/05*** | (2006.01) |

(52) U.S. Cl.

CPC ..... *B41J 35/04* (2013.01); *B41J 2/325* (2013.01); *B41J 31/05* (2013.01); *B41J 33/14* (2013.01); *B41J 2202/33* (2013.01)

(58) Field of Classification Search

None

See application file for complete search history.

(56) References Cited

U.S. PATENT DOCUMENTS 4,477,198 A * 10/1984 Bowlds ..... B41M 5/3825 400/198

7,931,413 B2 * 4/2011 Berson ..... B41J 31/05 400/240.3

FOREIGN PATENT DOCUMENTS

EP 3093153 A1 * 11/2016 ..... B41M 5/41

* cited by examiner

*Primary Examiner* — Leslie J Evanisko

(57) ABSTRACT

A media processing device includes: a media processing head; a ribbon transport assembly configured to transport ribbon along a ribbon path between a ribbon dispenser and the media processing head; a graphite applicator disposed along the ribbon path, the graphite applicator configured to apply a combination of graphite and graphene to an active side of the ribbon via frictional engagement with the ribbon; and a media transport assembly configured to transport media from a media supply to the media processing head for transfer of at least a portion of the combination of graphite and graphene from the active side of the ribbon onto the media via application of at least one of heat and pressure at the media processing head.

19 Claims, 5 Drawing Sheets

MEDIA PROCESSING DEVICES FOR APPLYING PRINTABLE CONDUCTIVE ELEMENTS

BACKGROUND

Conductive elements may be affixed to various surfaces, such as temperature and other sensors, memories storing identifiers or other data, or the like. Producing such conductive elements, however, may be costly and/or time consuming, reducing the value of deploying such elements.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
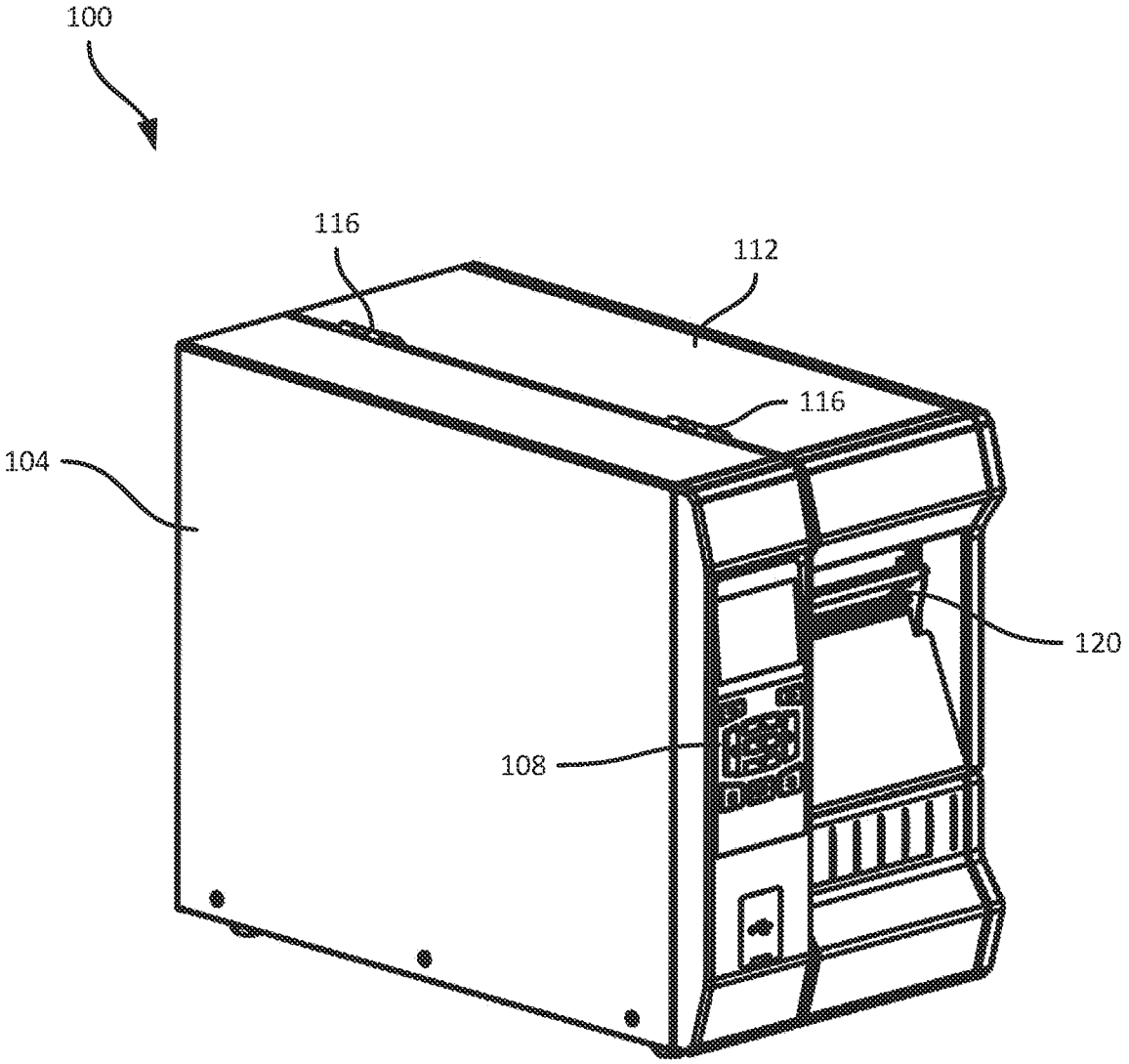
FIG. 1 is a diagram illustrating an isometric view of a media processing device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Deploying conductive elements as sensors, or portions of sensor circuits, may be desirable in a wide variety of contexts. For example, temperature and/or humidity sensors may be deployed on items such as packages to track cold-chain compliance, in medical settings such as on skin bandages, and the like. Applying such sensors (or components thereof) to surfaces such as packages, bandages, skin, or the like may be rendered less costly and time-consuming if the sensors or conductive elements thereof can be printed onto media such as a label or other substrate, rather than being previously manufactured, shipped and stored.

Deploying printable conductive elements, however, may require materials that are costly and/or time consuming to manufacture or otherwise prepare. For example, printable conductive elements may be deployed using a media processing device such as a thermal printer, equipped with media (e.g. labels or the like), and ribbon carrying a conductive material instead of, or in addition to, a pigment (e.g. ink). An example of such a conductive material is one or more layers of graphene or graphene oxide, a lattice of carbon with a thickness of one atom. Providing ribbon with a graphene coating may allow the media processing device to apply the graphene to the media in any of a wide variety of configurations, in a manner similar to the application of ink or other pigment to the media. Manufacturing graphene, however, is a costly and time-consuming process, which renders the use of graphene-coated ribbon for printing arbitrary conductive elements less appealing, and in some cases economically impractical. The discussion below sets out mechanisms for deploying lower-cost printable conductive elements.

Examples disclosed herein are directed to a media processing device, comprising: a media processing head; a ribbon transport assembly configured to transport ribbon along a ribbon path between a ribbon dispenser and the media processing head; a graphite applicator disposed along the ribbon path, the graphite applicator configured to apply a combination of graphite and graphene to an active side of the ribbon via frictional engagement with the ribbon; and a media transport assembly configured to transport media from a media supply to the media processing head for transfer of at least a portion of the combination of graphite and graphene from the active side of the ribbon onto the media via application of at least one of heat and pressure at the media processing head.

Additional examples disclosed herein are directed to a media processing device, comprising: a media processing head; a supply of ribbon having an active side, at least a portion of the ribbon having a combination of graphite and graphene releasable from the active side, the ribbon dispensable from the supply along a ribbon path towards the media processing head; a media transport assembly configured to transport media from a media dispenser to the media processing head, for transfer of a portion of the combination of graphite and graphene from the active side of the ribbon onto the media.

Further examples disclosed herein are directed to a method in a media processing device, the method comprising: controlling a ribbon transport assembly to transport a ribbon along a ribbon path from a ribbon dispenser toward a media processing head; at a graphite applicator between the ribbon dispenser and the media processing head, applying a combination of graphite and graphene to an active side of the ribbon via frictional engagement with the ribbon; controlling a media transport assembly to transport media from a media supply to the media processing head; and controlling the media processing head to transfer at least a portion of the combination of graphite and graphene from the active side of the ribbon to the media.

FIG. 1 illustrates a media processing device 100, such as a thermal transfer printer. The device 100 includes a housing 104 supporting various other components of the device 100, including a control panel 108 and various internal components to be discussed below. The internal components of the device 100 may be accessed via a door or cover 112, which in this example is movably coupled to the housing 104 via hinges 116. In general, the internal components mentioned above enable the device 100 to apply indicia, including indicia forming conductive elements, to media such as labels or the like, which is then output from the device 100 at an outlet 120.

Figure 2:
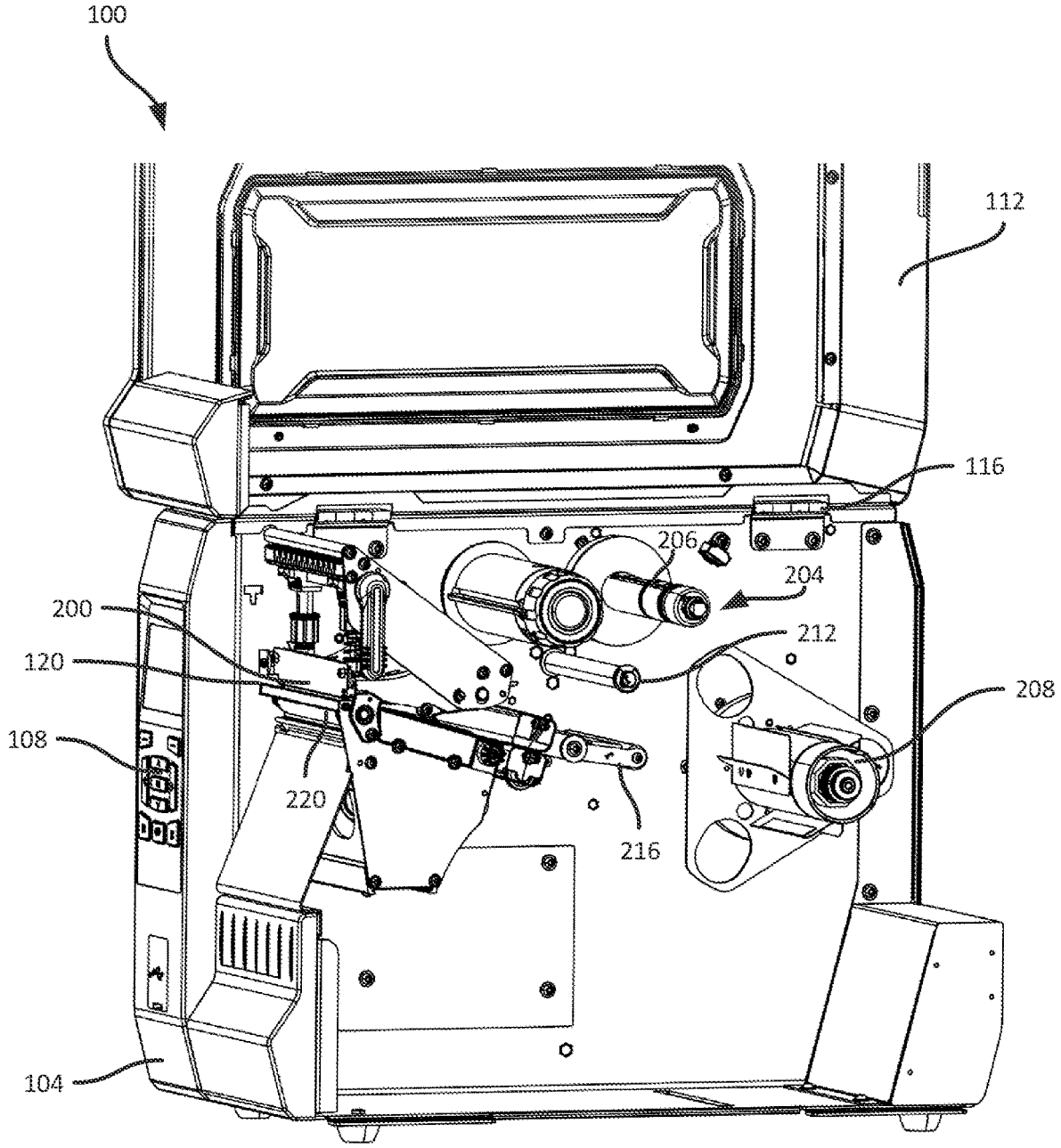
FIG. 2 is a diagram of the media processing device of FIG. 1, with a cover thereof in an open position.

FIG. 2 illustrates the device 100 with the cover 112 (shown only partially) in an open position to expose certain internal components of the device 100. In particular, the device 100, as mentioned above, is a thermal transfer printer, in which pigment and/or conductive material is transferred from a ribbon to media such as a label, paper, or the like. The media, following removal from the device 100 at the outlet 120, can then be affixed to a surface, or otherwise applied to the surface to transfer the pigment and/or conductive material to that surface. For example, the media can be applied to skin, to transfer conductive elements printed on the media from the media to the skin. In further examples, the media can include a wrist band, and the pigment and/or conductive material can be applied to an inner surface of the wrist band, to lie against the skin when the wrist band is worn. In such an implementation, the conductive material on the wrist band can form a sensor for use in medical settings, e.g. for identification and/or collecting physical measurements from a patient.

To transfer the pigment and/or conductive material from the ribbon to the media, the device 100 includes a media processing head, such as a thermal print head 200, as well as a ribbon dispenser 204 and a media dispenser 208. The ribbon dispenser 204 is a spindle 206 rotatably supported by the housing 104 in this example, and can support a spool of ribbon. The ribbon (not shown in FIG. 2) carries, on an active side thereof, the pigment and/or conductive material, and is dispensed from the dispenser 204 towards the print head 200, via a ribbon transport assembly that can include rollers and/or guide surfaces defining a ribbon path between the dispenser 204 and the print head 200. The ribbon transport assembly includes, in this example, a guide roller 212.

The media dispenser 208, in this example, is a spindle rotatably supported by the housing 104, to support a roll of media such as labels or the like (not shown in FIG. 2). The device 100 also includes a media transport assembly, which includes a suitable set of guide surfaces and/or rollers for guiding media from the dispenser 208 towards the print head 200. In this example, the media transport assembly includes a media dancer 216.

The transport assemblies mentioned above enable the transport of both ribbon and media from their respective supplies to the print head 200, which forms a nip with a platen roller 220. The nip brings the ribbon and the media into contact between the print head 200 and the platen roller 220. The print head 200 includes an addressable array of thermal elements that can be independently enabled or disabled by a controller of the device 100. For example, the array may disposed in a line across the media's travel path through the nip, such that controlling the array as the media traverses the print head 200 results in the application of heat to specific portions of rows extending across the ribbon as the ribbon and the media travel together through the nip. The application of heat to the ribbon by the print head 200 causes the pigment and/or conductive material at positions corresponding to the activated thermal elements to release from the ribbon and affix to the media. In other examples, the media processing head need not be an addressable print head as described above, but can instead be a thermal transfer roller, e.g. a single thermal element rather than multiple individually controlled elements.

The ribbon loaded into the device 100 prior to operation thereof may be manufactured with a layer of conductive material, such as graphene or graphene oxide. As will be apparent from the discussion below, the layer of conductive material can include a combination of graphene and graphite (e.g. a layer of graphene, overlaid with graphite). Although graphene is preferred to graphite in the context of printable conductive elements, the combination mentioned above may be implemented at a substantially lower cost and complexity relative to ribbon coated exclusively with high-purity graphene. In other examples, as discussed below, the ribbon supported on the ribbon dispenser 204 may not include the conductive material, and the device 100 itself can include additional components to apply the conductive material to the ribbon prior to processing of the ribbon and the media at the print head 200.

Figure 3:
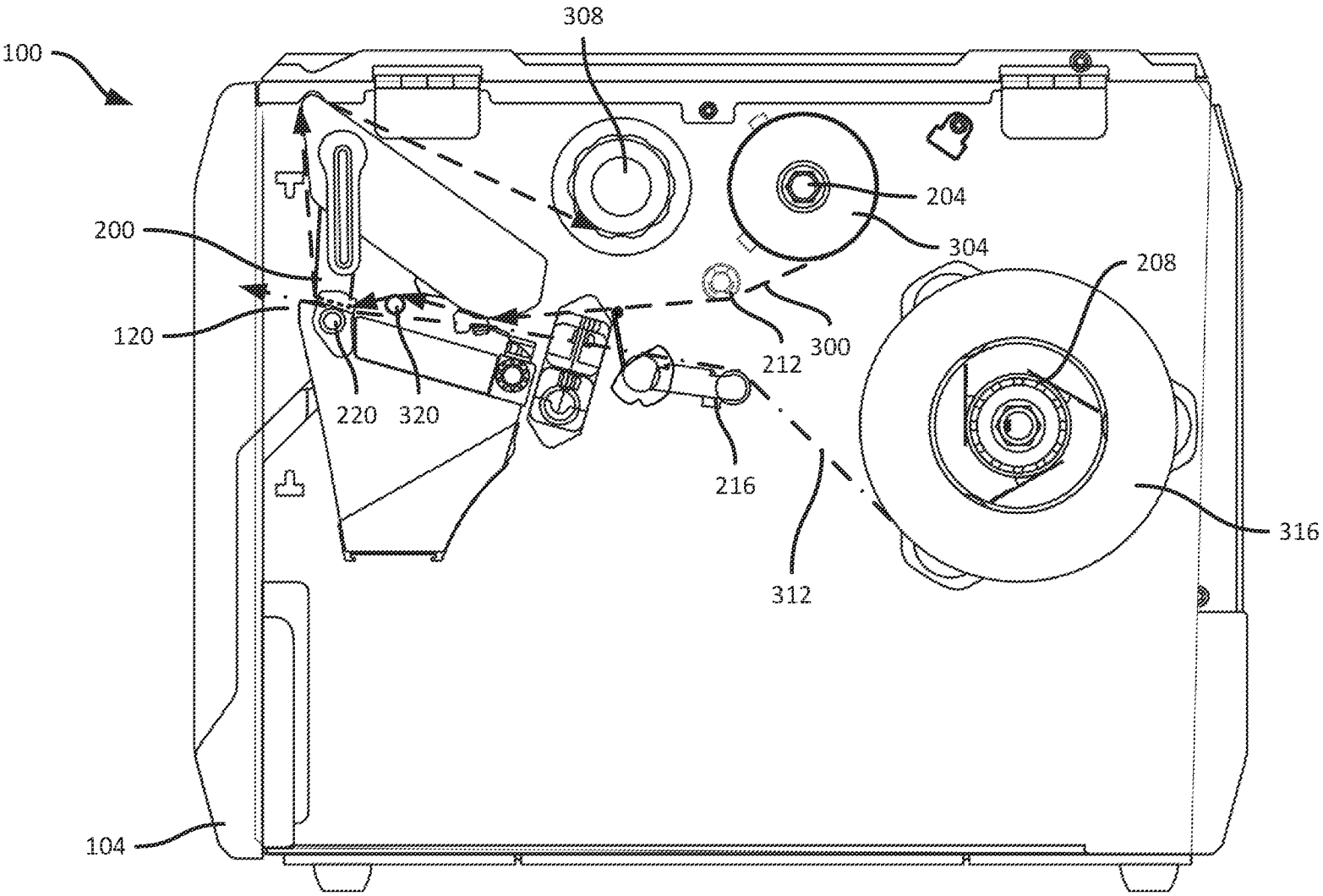
FIG. 3 is a side view of the media processing device of FIG. 1, illustrating certain internal components.

Turning to FIG. 3, a side view of the device 100 with the cover 112 removed is illustrated. In addition to the components mentioned above, a ribbon path 300 is illustrated, along which the ribbon travels from a ribbon supply 304 (e.g. a spool mounted on the dispenser 204), to the print head 200, before being collected by a take-up roller 308. A media path 312 is also illustrated, along which the media travels from a media supply 316 (e.g. a spool mounted on the dispenser 208) to the print head 200 and out the outlet 120. The device 100 also includes an applicator 320 disposed along the ribbon path 300. The applicator 320 is configured to apply a layer of conductive material to an active side of the ribbon. The active side is the side of the ribbon facing towards the media, and which will therefore be in contact with the media at the nip formed by the print head 200 and the platen roller 220. In the example of FIG. 3, the active side is the underside of the ribbon (i.e. the side facing the bottom of the drawing).

The applicator 320 can be a block of the constituent material forming the conductive material to be applied to the ribbon. In this example, therefore, the applicator 320 is a block of graphite, e.g. a cylindrical block over which the ribbon travels toward the print head 200. The applicator 320 can be an idle (i.e. non-driven) roller, or a static block that the ribbon rubs against as the ribbon passes towards the print head 200. For example, the applicator 320 can be fabricated as a block of graphite with a hardness equivalent to that of a 9B crayon. In some examples, the applicator 320 can be adapted from the core of a 9B crayon. Graphite softer than 9B can also be employed. In some examples, graphite harder than 9B may also be employed, however the applicator 320 preferably has a hardness no greater than that of a 2B crayon.

The applicator 320 can also include, in some examples, a leveling component at or downstream of the above-mentioned block of graphite, such as a doctor blade, a slot through which the ribbon travels towards the print head 200, or the like. The leveling component can scrape or otherwise remove material transferred from the block of graphite to the ribbon that exceeds a predetermined height, in order to produce a coating of graphite and graphene on the ribbon with a substantially uniform thickness.

As will be apparent to those skilled in the art, rubbing graphite against a surface, such as the active side of the ribbon, deposits both graphite and graphene on the surface. Implementing the applicator 320 in the device 100 enables the use of standard, readily available ribbon without complex and costly manufacturing techniques to deposit graphene thereon, at the cost of obtaining graphene contaminated to a degree with graphite. It has been found that despite such contamination, the resulting indicia applied to the media exhibit conductivity and temperature sensitivity indicative of the presence of graphene on the media in sufficient quantity to act as a sensor, or a portion of a sensor circuit.

As seen in FIG. 3, the applicator 320 is adjacent to the print head 200. That is, the applicator 320 is at least closer to the print head 200 than to the ribbon supply 304. Such a placement of the applicator 320 may reduce the distance travelled by ribbon that has been coated with graphene and graphite. As will be apparent, the graphite may shed from the ribbon as dust, which may accumulate in the device 100, and reducing the distance travelled by coated ribbon may therefore reduce the frequency with which the interior of the device 100 requires cleaning.

Figure 4:
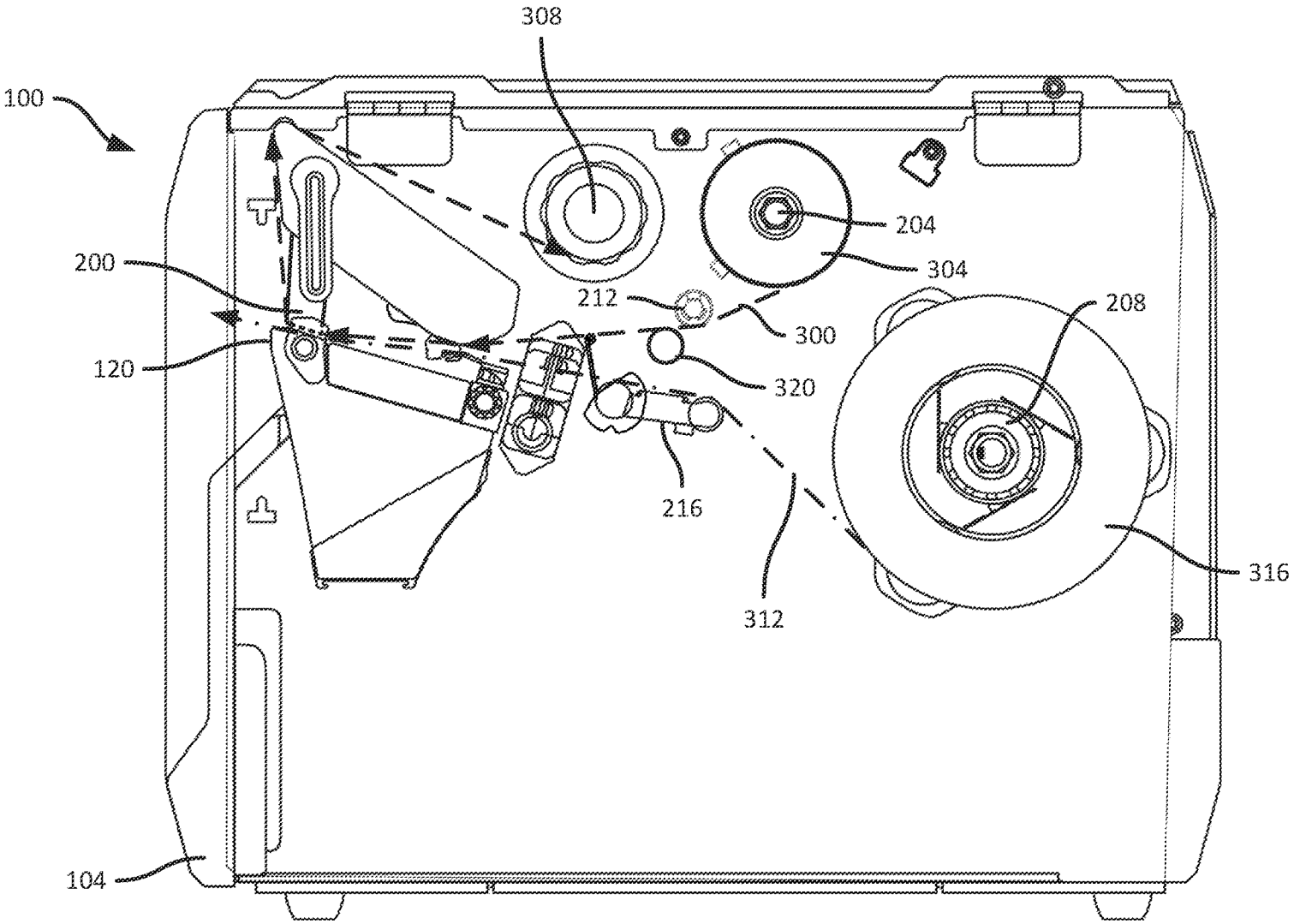
FIG. 4 is side view of the media processing device of FIG. 1, illustrating another example arrangement of certain internal components.

Turning to FIG. 4, another example is shown in which the applicator 320 is located adjacent to the ribbon supply 304, rather than to the print head 200. In such examples, the coated ribbon may travel further between the applicator 320 and the print head 200 and therefore may shed a greater amount of dust before the print head 200. However, in such examples the applicator 320 may also be deployed in a removable ribbon cartridge. That is, the housing 104 of the device 100 can be configured to removably receive a cartridge housing supporting the dispenser 204, the take-up roller 308, the guide roller 212, and the applicator 320. When the ribbon is exhausted from the supply 304, and/or when the applicator 320 has worn sufficiently to require replacement, the cartridge may be removed and replaced. In other examples, the applicator 320 alone may be replaced independently of the ribbon and/or the above-mentioned cartridge.

Figure 5:
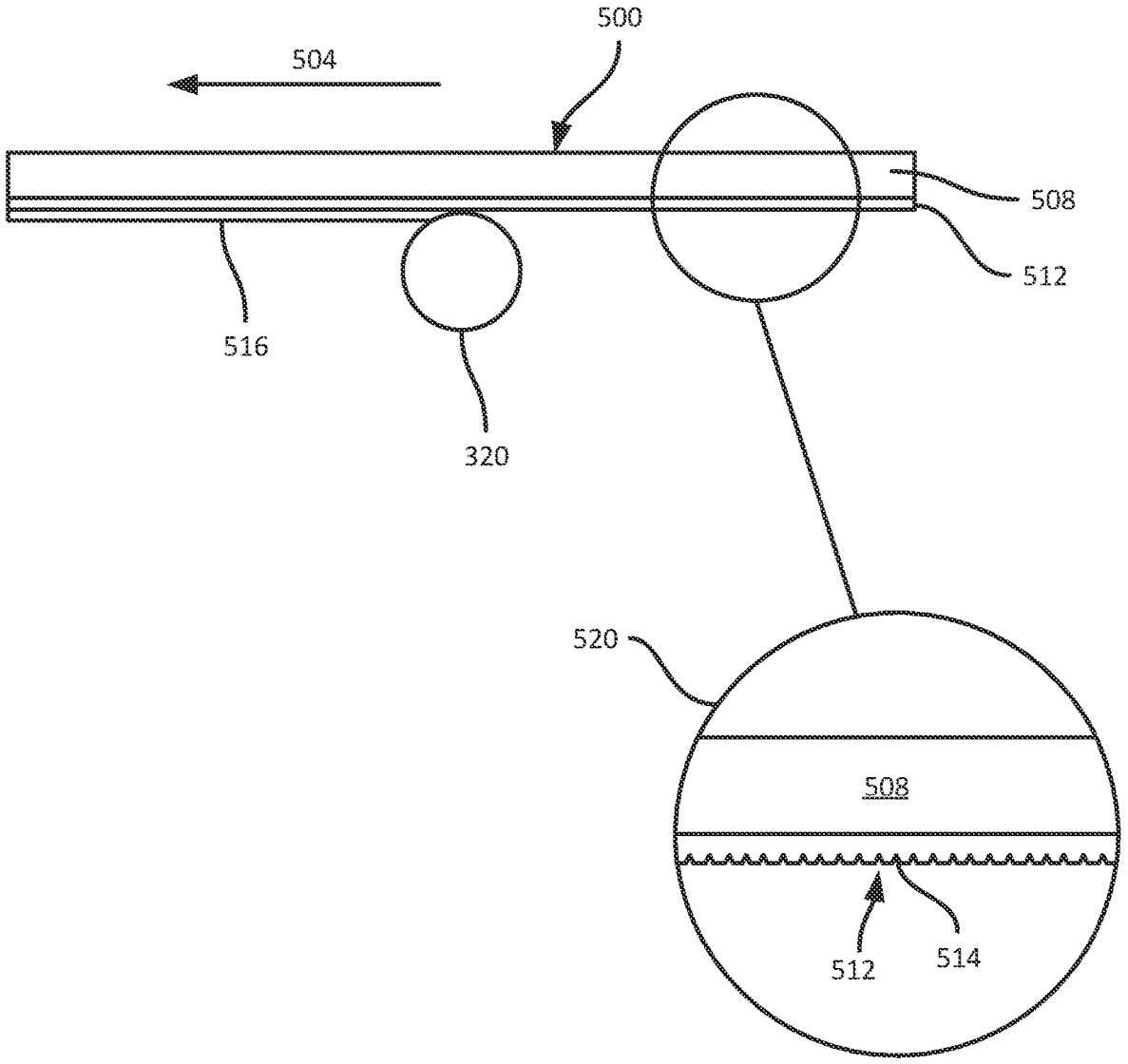
FIG. 5 is diagram illustrating a ribbon used in the media processing device of FIG. 1.

Turning to FIG. 5, application of the conductive material to the ribbon is shown in greater detail. In particular, a ribbon 500 is shown travelling past the applicator 320 in a direction 504, e.g. along the ribbon path 300 toward the print head 200. A portion of the ribbon 500, prior to contacting the applicator 320, includes a substrate 508 (e.g. a plastic or other suitable base material for the ribbon 500). The substrate can also include a thermally-activated release coating 512 defining the active side of the ribbon 500. As the ribbon traverses the applicator 320, a portion of the applicator 320 is transferred via friction onto the active side of the ribbon 500, forming a layer 516 of conductive material, which in the current example includes graphene and graphite. The thickness of the coating 516 of conductive material may be, for example, from about 100 nanometers to about 5 microns.

As shown in the detail view 520, the ribbon 500 may be provided with additional features to aid the conductive material from the applicator 320 in adhering to the ribbon 500. In particular, the coating 512 and/or the substrate 508 itself can include a surface treatment 514, such as a texture or increased roughness relative to the non-active side of the ribbon 500, to improve adherence of the conductive material. In other examples, e.g. in which the ribbon 500 is manufactured with a coating of conductive material rather than having the coating 516 applied within the device 100, the ribbon 500 may also include a protective coating overlaid on the conductive material, to mitigate the above-mentioned shedding of dust within the device 100.

The media used in the device 100 may also include a surface treatment 514, in some examples, such as a texture or area of increased roughness, to improve adherence of the conductive material to the media upon transfer at the print head 200.

Variations to the above are contemplated. For example, in some embodiments the device 100 can include two or more applicators disposed at different points along the ribbon path 300.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A media processing device, comprising:

a media processing head;

a ribbon transport assembly configured to transport ribbon along a ribbon path between a ribbon dispenser and the media processing head;

a graphite applicator disposed along the ribbon path, the graphite applicator configured to apply a combination of graphite and graphene to an active side of the ribbon via frictional engagement with the ribbon; and a media transport assembly configured to transport media from a media supply to the media processing head for transfer of at least a portion of the combination of graphite and graphene from the active side of the ribbon onto the media via application of at least one of heat and pressure at the media processing head.

2. The media processing device of claim 1, wherein the applicator includes a graphite member disposed in the ribbon path, to deposit the combination onto the active side of the ribbon as the ribbon traverses the applicator.

3. The media processing device of claim 2, wherein the applicator is a roller.

4. The media processing device of claim 2, wherein the applicator is static.

5. The media processing device of claim 1, wherein the applicator is adjacent to the media processing head.

6. The media processing device of claim 1, wherein the applicator is adjacent to the ribbon.

7. The media processing device of claim 1, wherein the ribbon dispenser includes a spindle configured to support a roll of ribbon.

8. The media processing device of claim 7, further comprising a housing, wherein the housing is configured to removably receive at least one of the spindle, a ribbon take-up spindle, or the applicator.

9. The media processing device of claim 1, wherein the media processing head includes an addressable thermal print head.

10. A media processing device, comprising:

a media processing head;

a supply of ribbon having an active side, at least a portion of the ribbon having a combination of graphite and graphene releasable from the active side, the ribbon dispensable from the supply along a ribbon path towards the media processing head;

a media transport assembly configured to transport media from a media dispenser to the media processing head, for transfer of a portion of the combination of graphite and graphene from the active side of the ribbon onto the media.

11. The media processing device of claim 10, further comprising an applicator disposed along the ribbon path, the applicator configured to apply the combination of graphite and graphene to the active side of the portion of the ribbon.

12. The media processing device of claim 11, wherein the applicator includes a graphite member disposed in the ribbon path, to deposit the combination onto the active side of the ribbon as the ribbon traverses the applicator.

13. The media processing device of claim 12, wherein the applicator is a roller.

14. The media processing device of claim 12, wherein the applicator is static.

15. The media processing device of claim 10, wherein the applicator is adjacent to the media processing head.

16. The media processing device of claim 10, wherein an active side of the ribbon includes a surface treatment to adhere the combination of graphite and graphene.

17. The media processing device of claim 16, wherein the ribbon includes a substrate, a release coating on a surface of the substrate corresponding to the active side, and the combination of graphite and graphene on the release coating.

18. The media processing device of claim 10, further comprising a supply of media at the media dispenser, the media including a surface treatment configured to adhere the combination of graphite and graphene.

19. A method in a media processing device, the method comprising:

controlling a ribbon transport assembly to transport a ribbon along a ribbon path from a ribbon dispenser toward a media processing head;

at a graphite applicator between the ribbon dispenser and the media processing head, applying a combination of graphite and graphene to an active side of the ribbon via frictional engagement with the ribbon;

controlling a media transport assembly to transport media from a media supply to the media processing head; and controlling the media processing head to transfer at least a portion of the combination of graphite and graphene from the active side of the ribbon to the media.

* * * * *